United States Patent [19]

Uhlyarik

[11] 4,149,393

[45] Apr. 17, 1979

[54] COMPRESSOR TYPE WASHING MACHINE

[76] Inventor: Emanuel J. Uhlyarik, 23309 Westbury Dr., St. Clair Shores, Mich. 48080

[21] Appl. No.: 857,204

[22] Filed: Dec. 5, 1977

[51] Int. Cl.[2] ..... D06F 15/00

[52] U.S. Cl. ..... 68/21; 68/122; 68/125; 68/129; 68/208; 68/210; 100/116

[58] Field of Search ..... 68/21, 43, 50, 122, 68/125, 129, 156, 208; 100/116, 125

[56] References Cited

U.S. PATENT DOCUMENTS

| | | | |
|---|---|---|---|
| 1,380,076 | 5/1921 | Newsome | 68/122 |
| 1,881,851 | 10/1932 | Moussette | 68/122 |
| 2,041,471 | 5/1936 | Hasbrouck | 68/122 X |
| 2,138,334 | 11/1938 | Becquet | 68/122 X |
| 2,534,674 | 12/1950 | McFarland | 68/122 |

FOREIGN PATENT DOCUMENTS

| | | | |
|---|---|---|---|
| 991837 | 6/1951 | France | 68/122 |
| 295447 | 4/1932 | Italy | 68/21 |

*Primary Examiner*—Philip R. Coe

*Attorney, Agent, or Firm*—Dolgorukov & Dolgorukov

[57] ABSTRACT

The specification discloses an improved washing machine having an outer wash tub adapted to be filled with water to a desired predetermined level. An inner perforated washtub is mounted in a concentrically spaced relationship to said outer wash tub and is adapted to receive the clothes to be washed. A compressor unit is adapted to reciprocate from the top to the bottom of said wash tub to briefly agitate the clothes and then to squeeze the water from them from the inside out.

24 Claims, 10 Drawing Figures

Fig-3
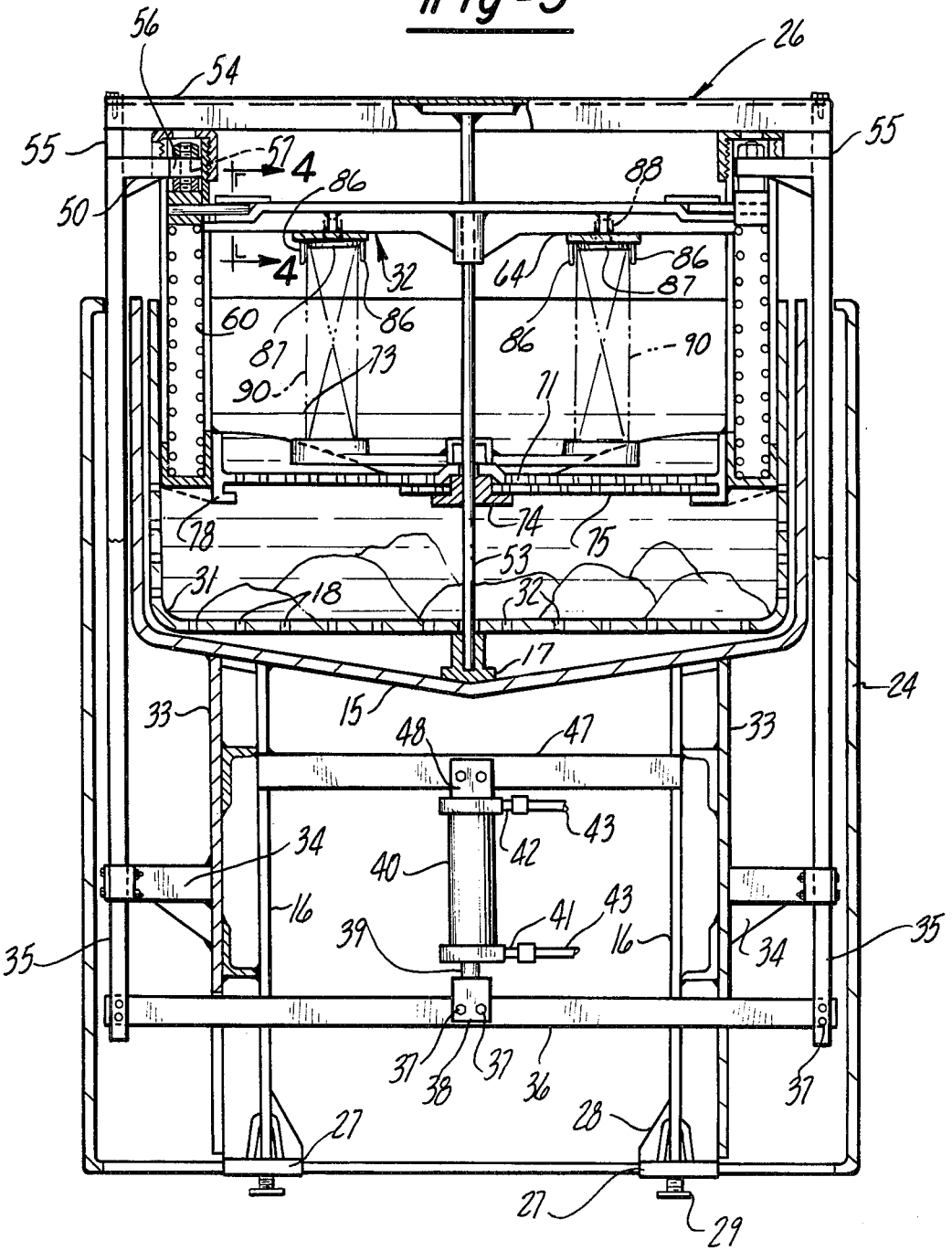
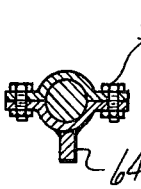
Fig-4

COMPRESSOR TYPE WASHING MACHINE

The present invention deals with washing machines, and more particularly with an improved washing machine of the type designed to compress clothes, thereby driving the water and soap solution from the inside of the clothes to the outside thereof and removing dirt therewith without passing it through the clothes. This is in contrast to present day washing machines wherein a strong detergent is actually doing the cleaning, with said detergent dissolving dirt, but passing it into, as well as out of, the clothes being washed.

The subject matter of the present application was first disclosed in Disclosure Document No. 059129 filed on Mar. 25. 1977.

Before the advent of the present day washing machine, clothes were washed by a variety of methods, all of which in the end involved squeezing the clothes to force the water and cleaning solution from the inside of the clothes being washed to the outside thereof, with the result that the solution came into contact with the soiled outer surfaces of the clothes for a last time when being forced therefrom and carried the soil into the wash water. Whether this took place by the use of washboard, or by wringing the clothes by hand, or other methods, such methods were very efficient and time saving, if not labor saving, as it was the mechanical squeezing of the clothes and forcing the dirty water out of them which actually did most of the cleaning. One was not constantly circulating dirty water through the clothes, and could do individual pieces of clothing very quickly. I have adapted this idea to the present day washing machine by providing a novel apparatus where many pieces of clothing may be compressed at one time to force the water from the inside thereof, and utilize the process just described, to wash clothes much more efficiently than the present washing machine. Such process also is very energy efficient as the cycle time of my automatic washing machine is greatly reduced by use of the aforementioned method, thereby using much less electric current.

Further, I now eliminate the need for harsh detergents, with the resultant polution of our water supply, and am able to use inexpensive mild soaps. Thus, one of the objects of my invention is to provide for an automatic washing machine of the type which will briefly agitate a load of washing and then press the water out of the clothes, thereby forcing the water and soap solution from the inside of the particular pieces of clothing being washed, to the outside thereof, thereby removing the dirt therefrom.

A further object of the present invention is to utilize and adapt the method commonly used for washing clothes before the advent of the present day washing machine for use in home or commercial laundries.

A further object of the present invention is to save the time of housewives by providing for an automatic washing machine which takes a bigger load of clothes than heretofore possible, and washes them in a reduced amount of time.

A further object of the present invention is to conserve electric energy by providing a washing machine which can wash a load of clothes in less time than previously possible.

A still further object of the present invention is to reduce the expense of washing clothes by providing for the use of inexpensive mild soaps in place of the present day harsh detergents and because less use of water is needed washing clothes with pressure system, less soap is required to do the washing.

A still further object of the present invention is to produce an automatic washing machine of greatly simplified construction at significantly reduced prices.

Further objects and advantages of this invention will be apparent from the following description and appended claims, reference being had to the accompanying drawings forming a part of the specification, wherein like reference characters designate corresponding parts in the several views.

FIG. 3 is a sectional view taken in the direction of the arrows along the section line 3—3 of FIG. 2.

FIG. 4 is a sectional view taken in the direction of the arrows along the section line 4—4 of FIG. 3.

Figure 1:
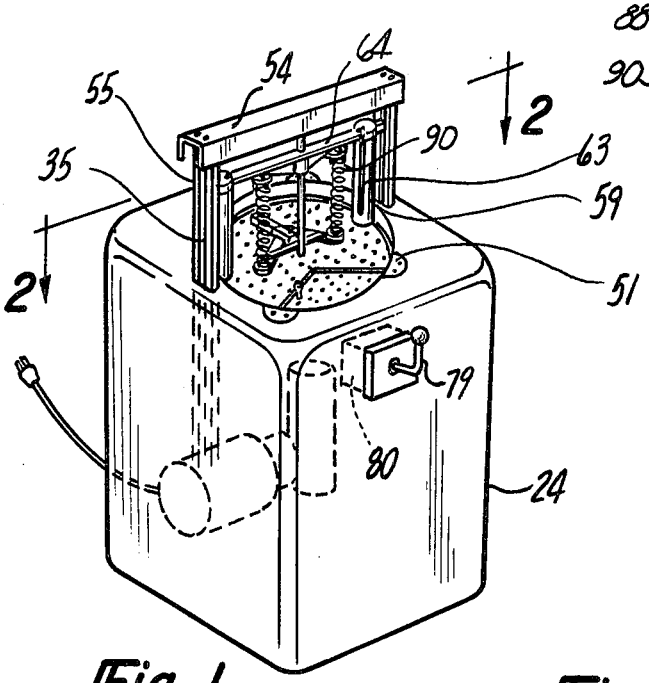
FIG. 1 is a perspective view of a washing machine embodying the construction of my invention.
Figure 9:
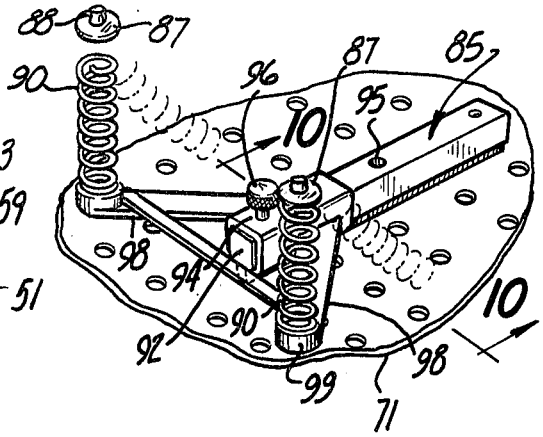
FIG. 9 is a fragmentary view showing the booster spring and its associated positioning means fastened to the main plate of my improved compressor type washing machine.
Figure 10:
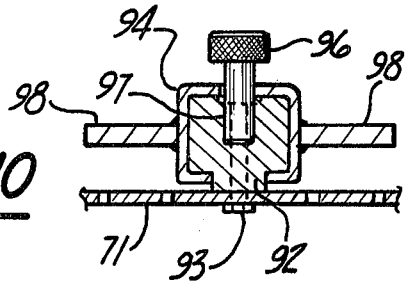
FIG. 10 is a sectional view taken in the direction of the arrows along the section line 10—10 of FIG. 9.
Figure 2:
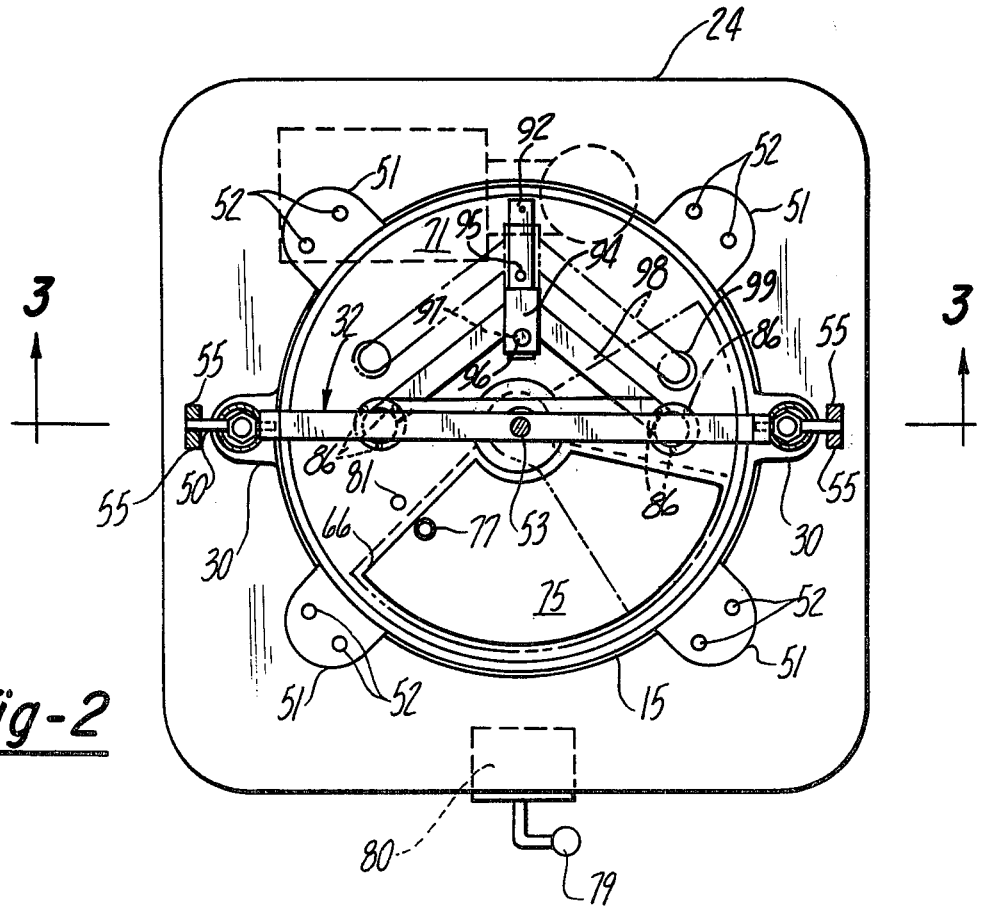
FIG. 2 is a plan view of the washing machine of FIG. 1, but showing more detail.

It is to be understood that the invention is not limited in its application to the details of construction and arrangement of parts illustrated in the accompanying drawings, since the invention is capable of other embodiments, and of being practiced or carried out in various ways within the scope of the claims. Also it is to be understood that the phraseology and terminology employed herein is for the purpose of description and not of limitation.

To construct an automatic washing machine which would wash clothes from the inside of the fabric out by utilizing a number of soaking and agitating cycles followed by a cycle where water and cleaning solution were extracted from the garment being washed by a compressing operation, and to achieve the other objects of my invention involved quite some experimentation which ultimately led me to the conclusion that if a large number of garments could be pressed at a single time in a machine resembling the standard home washing machine as closely as possible, my objects would be achieved and a machine would be provided for the housewife which would meet a minimum of resistance. After much experimentation, I arrived at a construction utilizing a relatively small number of parts having an inherently long life which could be made available at considerably reduced prices over those now charged, due to the simplicity of the construction.

The preferred embodiment of my invention consists of an outer washing tub 15 mounted on a plurality of leg supports 16, with four such supports being the preferred number. There may be a drain opening 20 provided in the exterior lower portion of the tub 15. A valve 25 may be connected to the opening 20, and then connected by means of a hose 22 to the exterior of the machine through an opening 23 which is provided in the cabinet 24, which is fastened to the leg supports 16 and other portions of the machine as necessary to provide proper support therefor.

The bottom portion 27 of the leg 16 may have suitable reinforcements 28 and adjustable pads 29 provided therein as desired. An inner wash tub 31 of somewhat smaller diameter than the outer tub 15 is provided to fit concentrically inside said outer tub 15, and is provided with two mutually recessed portions 30 for purposes which will be described herein below. The inner wash tub is provided with multiple perforations 18 so that water may freely flow into and out of said wash tub.

A compressor unit generally designated by the numeral 32 is adapted to reciprocate in a vertical direction in said recessed portions in a manner to be herein described, and a compressor unit support means generally designated by the numeral 26 supports the unit 32. To accomplish the reciprocation, a pair of steel plates 33 are mounted in an opposed relationship to a pair of said support legs 16. To the plates 33 are mounted a pair of lower guideways 34 adapted to slideably receive a pair of push rods 35. A channel 36 is operatively fastened between the push rods 35 by suitable fastening means such as the bolts 37. A mounting bracket 38, which again may be fastened to the channel 36 by suitable fastening means such as the bolt and nut assembly 37, is adapted to receive the piston rod 39 of a hydraulic cylinder 40. The hydraulic cylinder may be of a double acting type having conduits 41 and 42 communicating with the interior thereof and connected to a suitable hydraulic pump (not shown) by the conduits 43.

It should be understood that the hydraulic system to operate the compressor unit 32 is not per se part of the present invention, and it is believed that the construction of a suitable hydraulic system to operate the cylinder 40 is well within the skill of the art and need not be described herein in detail. It should be also understood that although a hydraulic cylinder and a hydraulic system are the preferred means of reciprocating the channel 36, other means such as air cylinders, cylinders operated by other fluids or gases, and the like, are within the scope of the present invention, as are automatic programmers to program the cycle of the machine in a manner to hereinafter be described. The provision of suitable gearing (not shown) will also allow the machine to be manually operated, if desired.

The cylinder 40, in turn, is secured to a mounting channel 47 which is operatively supported between two legs 16, preferably an opposite pair from that to which the steel plates 33 are connected. A bracket 48 may be employed for this purpose, if desired.

Figure 7:
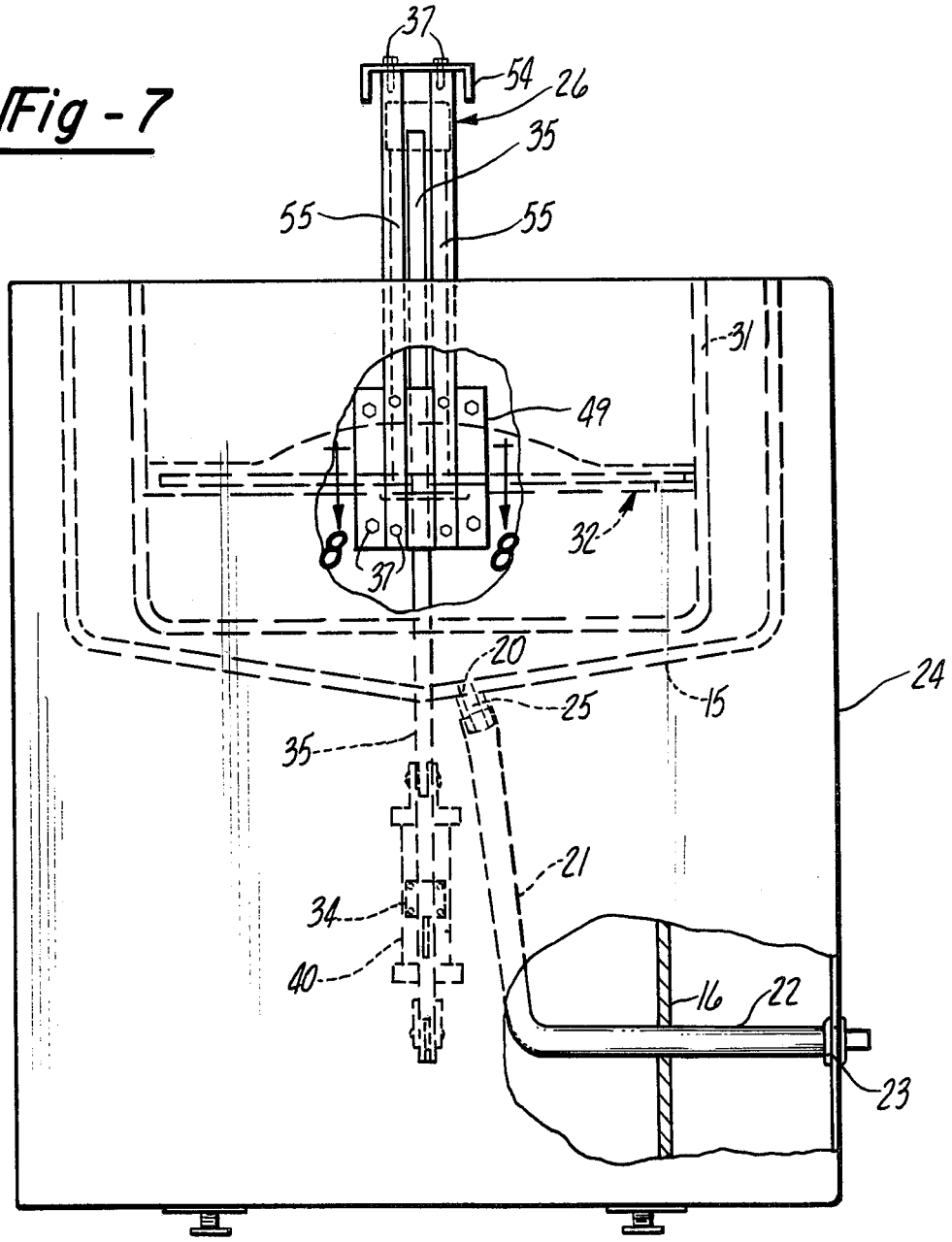
FIG. 7 is a cutaway elevational view of my improved washing machine showing means for draining the outer wash tub, and showing the support bracket for the compressor unit support arms.
Figure 8:
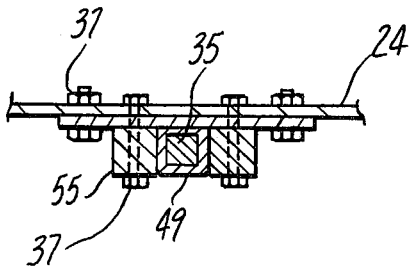
FIG. 8 is a sectional view taken in the direction of the arrows along the section line 8—8 of FIG. 7.

A pair of upper guideways, one of which is best shown in FIG. 7, and which is generally designated by the numeral 49, supports the upper end of the push rods 35 with each of the push rods having an extended short arm portion 50 fixedly mounted to the upper end thereof for purposes to be more fully explained below.

Figure 5:
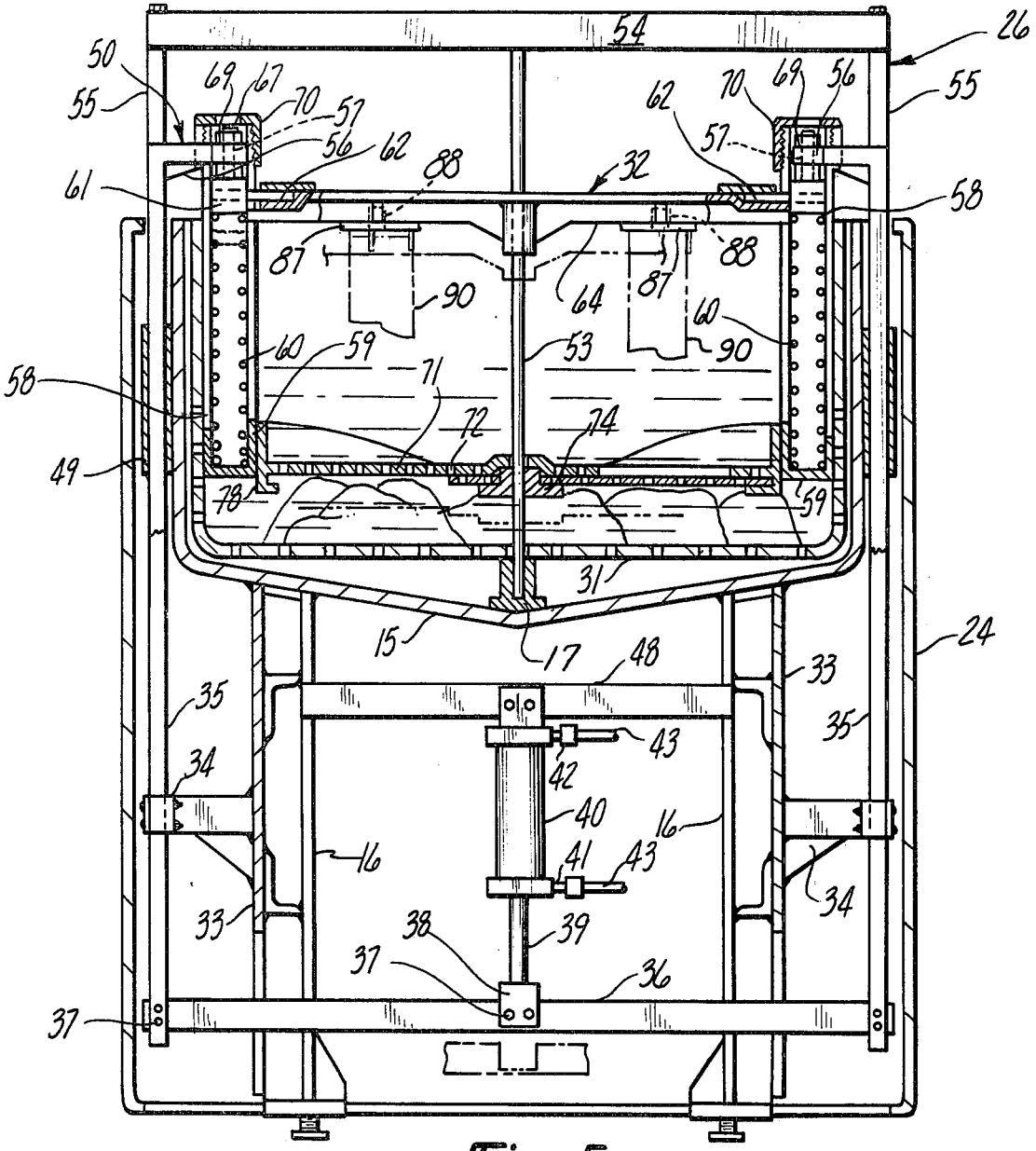
FIG. 5 is similar to FIG. 3, but shows the compressor unit of my automatic washing machine just at the point where it compresses the clothes to the point where little additional travel of the compressor unit will occur.
Figure 6:
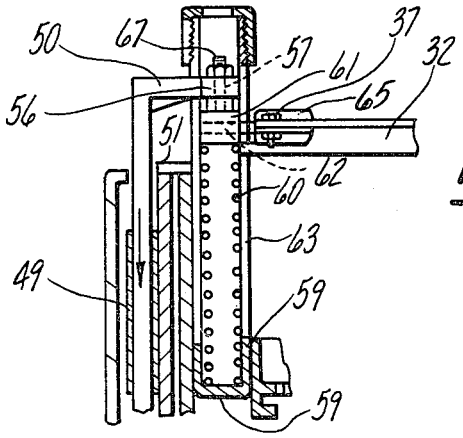
FIG. 6 is an enlarged view of a portion of the compressor unit shown in FIG. 5.

To complete the description of the relationship between the inner wash tub 31 and the outer tub 15, said inner tub and said outer tub are both furnished with flanges 51 with mating pairs of holes 52 provided therein. Suitable fastening means are passed through the holes 52 and operatively and fixedly connected to the cabinet 24 and flanges provided on outer tank, thereby holding the tubs in a concentric spaced relationship as best shown in FIGS. 3 and 5. A support bushing 17 is centrally located in the bottom of the outer tub 15 and is adapted to receive a rod 53 which is fastened to the support bushing 17 by any suitable fastening means. The other end of the rod 53 is fastened to a channel 54 which is supported by a plurality of support bars 55 fastened to the upper guideways 49 by suitable fastening means 37, thus completing the compressor unit support means 26.

It can now be seen that the push rods 35 reciprocate in a vertical direction between the support bars 55 for a substantial portion of their length and are terminated at their upper end by a said extended short arm portion generally designated by the numeral 50 which has a circular-shaped portion 56 with an opening 57 provided therein.

The circular portions 56 of each of the push rods 35 are adapted to reciprocate through a first groove 58 provided in a tubular construction generally designated by the numeral 59.

Inserted in each of the tubular constructions 59, before the remaining parts are assembled, are a pair of compression springs 60 which loosely fit therein. Resting on top of each of the compression springs 60 is a union generally designated by the number 61, which is of generally circular cross section and is adapted to reciprocate with the spring in the interior of the tubular construction 59. Extending at right angles to the axis of reciprocation of the union is a mounting pin 62 adapted to extend through the second groove 63 and extend a predetermined distance there beyond for purposes of attachment of the crossbar 64 between the two tubular constructions 59. The purpose of the crossbar is to stabilize the compressor unit and to provide increased pressure by way of the springs 60 applied between the crossbar and main plate of compressor unit. It can now be seen that if the tubular constructions 59 were held stationary and downward pressure exerted on the crossbar 64, the crossbar would compress the springs 60 inside the tubular construction 58, and in the absence of the pressure, the tubular construction 59 and the spring 60, the union 61, and the pins 62 forming a portion of the compressor unit 32 would reciprocate. It should be noted that the crossbar 64 may be attached to the pin 62 by any suitable means, such as the adaptor plate 65, and the bolt and nut assembly 37.

The portion of the compressor unit 32 described thus far is made to reciprocate within the inner wash tub 31 by means of its being attached to the circular sections 56 of the push rods 35 on either side of the laundry tub. This is accomplished by providing a stud-like projection 67 fixedly attached to the union 61. A hole 68 is then provided in the circular portion 56 and a suitable nut of annular construction 69 is tightened down onto the portion 56. Suitable end caps 70 enclose the otherwise open ends of the tubular construction 59 and prevent any possibility of the push rods and union assemblies becoming dislodged from the said construction. The compressor unit is completed by providing a main plate 71 of a shape substantially identical with the cross section of the inner wash tub 31 (excluding the recessed portion 30) and fixedly attaching it by any suitable means, such as screws, bolts, welding or the like, to both of the constructions 59 so that it is in a vertical plane and will reciprocate with the compressor unit 32 in a manner to be hereinafter described. The main plate 71 has a plurality of perforations 72 to allow water to circulate therethrough, as well as a filler opening 66 to allow clothes to be inserted therethrough into the tub 31.

Referring to FIG. 3, the compressor unit, and thus the main plate 71, is shown in its normally raised position with the inner wash tub filled to a level indicated by the numeral 73. It can be seen than a channel 74 is provided about the lower extremity of the main plate 71 into which the outer edge of a sliding filler opening cover plate 75 rotates perpendicular to the axis of the rod 53 to open and close the filler opening 66 provided in the main plate 71. To facilitate this movement, there is provided a knob or other suitable appendage 77 on the plate 75, and to secure the plate 75 in a closed position during reciprocation of the compressor unit 32, a lock pin assembly 81 is provided. It should be understood that knobs and locking pins are well known in the art, and that any suitable locking means can be used and be well within the scope of the present invention.

It should be further understood that the main plate need only be of a substantially similar diameter to the inner wash tub, which can be of any desired cross section. It may also be seen that the main plate 71 may be of one piece or multiple piece construction depending on the methods chosen to manufacture it, and still be well within the scope of the claims.

It can now be seen that the compressor unit 32 is constrained to reciprocate in a vertical direction inside the inner wash tub 31. Such unit is formed of the tubular constructions 59 fastened to the main plate 71, with such tubular constructions each having a first groove 58 and a second groove 63, with said first groove adapted to receive a T-type extrusion 50 provided on the ends of the push rods 35. The tubular constructions 59 are fastened about the push rods 35 by the end cap 70. To each of the circular portions 56 of the push rods 35 there is attached a union 61 by means of the stud 67 and annular nut 69. The union 61 rests on top of the compression spring 60 and there is provided therein a pin 62 to which is attached by suitable fastening means the crossbar 64. The filler opening cover plate 75 slideably rotates in the channel 78 provided about the extremity of the main plate 71 and the channel formed between the bushing 74, which is fixedly attached or integral with the main plate 71, and the main plate itself, and such entire compressor unit reciprocates in a vertical direction as long as it encounters no resistance in its path. It is guided by the rod 53 attached between the channel 54 and the outer wash tub 15.

In operation, with the compressor unit 32 in its uppermost position, water would be introduced into the outer wash tub 15 in a suitable amount for doing a load of clothes, and would naturally pass through the perforations into the inner wash tub 31 as shown in FIGS. 3 and 5. The locking pin 81 would be released and the filler plate 75 would be opened with the assistance of a knob 77 and clothes are inserted through the filler opening 66. The cover plate 75 would then be closed and locked and by said locking pin 81 which it should be understood is well known in the art.

An oil operated, liquid, or mechanical means would be used to reciprocate the compressor unit by causing movement of the push rods 35 by virtue of the reciprocation of the channel 36 by said suitable means. In the preferred embodiment, as mentioned above, the suitable means take the form of a suitable hydraulic pump and control mechanism (not shown) which operate through the hoses 43 to cause the piston rod 39 of the double action hydraulic cylinder 40 to reciprocate. It is not believed necessary to show the hydraulic mechanism in any greater detail than shown herein, as such is known in the art, and it is only deemed necessary that the selected operation of the circuit is such as to cause the compressor unit to reciprocate up and down, just contacting the clothes for a predetermined number of cycles based on how soiled the clothes are, so that the clothes are fully wet by the water and cleaning solution. After this portion of the cycle is completed, the wash tub is emptied, and the hydraulic circuit is caused to extend the push rod 39 to its full length so as to cause the compressor unit 32 to go to its lowermost position. It can be seen that at the point where the main plate 71 comes in contact with the clothes by virtue of the pressure exerted by the compression spring 60 on the union 61 and the end of the tubular construction 59, the main plate 71 will continue on its downward course pressing the water out of the clothes much like the early washboards or wringing operation did. When the clothes are compressed in sufficient amount to overcome the resistance of the compression spring 60, which may be chosen to have a suitable spring co-efficient depending upon the anticipated use of the washing machine, whether for home use or commercial use, it can be seen that the main plate 71 will now continue to move down only very slowly because it is able to further compress the clothes in a very limited amount.

To maintain the additional pressure and still provide for proper operation of the mechanism, it can be seen that when the main plate 71 does meet this resistance, rather than a physical breaking of the mechanism the push rods 35 will continue to move downwardly, although in this instance since resistance in sufficient amounts to overcome the compression springs 60 is present, such springs will start to be compressed and the portions 50 of the push rods 35, by virtue of their attachments to the union 61, will simply cause such unions to move in a downwardly direction compressing the springs 60 until they reach the bottom of their stroke all the while springs absorbing compressed volume of clothes. It can be seen that the actual length of the stroke of the main plate, which forms part of the compressor unit, is determined by the size of the wash load and the spring coefficient of the springs in the compressor unit. While this is happening, the crossbar 64 is moving downwardly in the second grooves 63. At this point the control lever 79 mounted on the control valve 80 may be positioned to reverse the direction of the cylinder 40, again raising the entire compressor unit 32 to its uppermost position, thereby completing the washing cycle of the clothes and meanwhile during upward movement of compressor unit clothes in wash are absorbing soapy solution for next stroke down.

It can be seen that a very short amount of time is necessary to reciprocate the compressor unit for a small predetermined number of times, and then squeeze the water out of the clothes from the inside out, thus removing the dirt from the clothes in a much more efficient manner than the present day washing machines. After this operation, the valve 25 may again be closed and the outer tub 15 filled with water to the level 73, with the water again passing through the perforations 32 in the inner tub and the main plate 71. The cycle just performed may be repeated for the equivalent of the rinse cycle in the present day washing machines, all of this taking place in a very short amount of time.

By experimentation, I have found that a typical cycle in my machine takes from 12–15 minutes instead of the approximately 30 minute cycle of present machines, or in other words, only one half the time, thus making great savings in energy.

A typical cycle in my machine might consist of approximately 3–5 minutes to load the machine, followed by agitation of the clothes at the rate of 7–8 strokes per minute and a compression stroke, and then a repeat of the agitation and compression strokes, for another 9–12 minutes of cycle time, making a total of 12–15 minutes.

To provide additional pressure on the clothes for use only in the compression portion of the cycle wherein the clothes are compressed to force the cleaning solution therefrom, booster spring means 85 are employed. Included therein are a pair of booster springs 90 between the crossbar 64 and the main plate 71. Spring pads 91, each having 3 equally spaced downwardly projecting locating pins 86, are operatively fixed to the crossbar 64. A washer 87 having a locating pin 88 is fixedly mounted to each of the springs 90 at their upper ends. Since these springs are only used during the compression portion of the cycle, they are disengageable by moving them away from a vertical position. This is accomplished by fixedly mounting a substantially T-shaped guideway 92 to the main plate 71 by suitable means, such as the studs 93. Over the guideway 92 there is slideably mounted an inverted C-shaped channel 94 which is adapted to reciprocate along the channel. Holes 95 and 97 are provided in the guideway 92 proximate the ends thereof and are selectably engageable by a locking pin 96 mounted on the channel 94. Radially extending arms 98 are attached to the channel 94 and are adapted to hold lower spring pad and sleeve means 99 to which the lower ends of the springs 90 are mounted. It can be seen when the locking pin 96 is engaged in the hole 97, the springs 90 will be in their vertical position and will tend to be compressed during the portions of the cycle when the crossbar 64 is permitted to go to its fully down position for compressing the water out of a load of clothes. However, for portions of the cycle when the clothes are being allowed to be circulated in the soap solution, and the crossbar 64 is only slightly compressing the spring 60, no additional force is needed so that the springs may be moved to their relaxed position by disengaging the lock pin 96 from the hole 97 and sliding the channel 94 along the member 92 until the pin 96 can be engaged in the hole 95. At this time substantially no compression of the springs will occur upon only slight movements of the crossbar 64.

Thus, by abandoning the use of an agitator to agitate clothes through a washing solution containing powerful detergents which clean the clothes, but also contribute to shorter life of clothes by premature deterioration of the clothes material and excessive water pollution, and adapting the old-time method of squeezing the clothes from the inside out to force dirt from the clothes, I have achieved all of the objects listed above and numerous additional objects and advantages.

I claim:

1. A washing machine including an outer wash tub, an inner perforated wash tub mounted concentrically in said outer wash tub, a compressor unit including a pair of compression springs mounted in said compressor unit and a main plate attached to and interposed between said compressor springs, said compressor unit being mounted to reciprocate within said inner wash tub, a compressor unit support means connected to said compressor unit, driving means connected to said compressor unit to receiprocate said compressor unit in a predetermined fashion, and means to drive said compressor unit driving means, the stroke of said main plate being variable and depending on the amount of clothes placed in said washing machine and the spring coefficient of said compression springs, said washing machine thereby adapted to briefly agitate the clothes in the washing machine and then to squeeze the water from them from the inside out.

2. The device defined in claim 1, and having a plurality of supporting legs mounted to said outer wash tub.

3. The device defined in claim 2, wherein said compressor unit driving means include a double acting hydraulic cylinder fixedly mounted to said supporting legs, a hydraulic pump, a plurality of hoses as required to operate the hydraulic system connected to said pump, a suitable control valve interposed between said pump and said cylinder, and a suitable driving means for said pump operatively connected thereto.

4. The device defined in claim 3, wherein said compressor unit driving means include a pair of lower guideways mounted to said supporting legs in a 180° opposed relationship, a pair of upper guideways mounted to said outer wash tub in 180° opposed relationship on a common axis with said lower guideways, a pair of push rods slideably mounted within each pair of said upper and said lower guideways, a connecting channel fixedly mounted between the lower ends of said push rods to connect the same, and a bracket connecting the piston rod of said hydraulic cylinder to said channel, all adapted to reciprocate said push rods in a vertical direction, said push rods including at their upper extremity an extended short arm portion each having a circular portion thereon with a hole provided in the center thereof.

5. The device defined in claim 4, wherein said compressor unit support means include a pair of support bars mounted in a spaced parallel relationship on each of said upper guideways and extending for a substantial predetermined distance above the top surface of said outer wash tub, a channel extending between and fixedly mounted to each pair of said support bars, a supporting rod centrally fastened on said channel and extending between said channel and the center of said outer wash tub, a support bushing fixedly mounted to the center of said outer wash tub on the inside thereof and adapted to receive the lower end of said rod, thereby providing for stabilizing of the compressor unit.

6. The device defined in claim 5, wherein said compressor unit includes a pair of tubular constructions each having a first groove and a second groove provided therein and being adapted to be mounted about said circular portions of said short arm portion in a 180° opposed relationship, one ax said compression springs loosely inserted into each of said tubular constructions, a pair of unions of circular cross section slideably fitted into tubular constructions and resting on top of said compression springs, said unions having a stud extending upwardly co-axially with said coil springs and having a mounting pin extending at right angles therefrom, said unions being fastened to said circular portion of said extended short arm portions to reciprocate in a vertical direction in said first grooves, and said mounting pins to likewise reciprocate in said second grooves, said compressor unit further including a cross bar adapted to slideably reciprocate along said rod and being mounted at each end to said mounting pins by suitable fastening means, and a main plate fixedly mounted at each end thereof to the lower extremity of said tubular construction and adapted to reciprocate with said tubular constructions, said main plate having an opening to permit the passage of said rod therethrough.

7. The device defined in claim 6, wherein said inner wash tub is of substantially similar cross section to that of said outer wash tub with the exception of recessed portions provided therein in a 180° opposed relationship to receive said tubular constructions.

8. The device defined in claim 7, wherein said outer wash tub, said inner wash tub and said main plate are of substantially circular cross section.

9. The device defined in claim 8, wherein said main plate has a groove extending around the periphery thereof, a support bushing having an opening therein aligned with the opening in said main plate for passage of the rod and being of a suitable cross section to form a groove about the periphery thereof, a filler opening provided in said main plate to allow the insertion of clothes, and a filler opening cover plate adapted to slide in said support bushing and said main plate grooves to cover and uncover said filler hole as desired.

10. The device defined in claim 9, and including a suitable gripping means provided on said filler opening cover plate and a locking pin means provided on said main plate adjacent said filler opening cover plate to selectively engage and disengage said filler hole cover plate as desired to permit the loading of clothes at the beginning of the wash cycle, and to secure the plate in a closed position during said wash cycle.

11. The device defined in claim 10, wherein both said main plate and said cover plate are perforated.

12. The device defined in claim 11, and including selectively engageable booster spring means interposed between said crossbar and said main plate and adapted to place additional pressure on said clothes during a compression cycle thereby aiding in squeezing the water from said clothes from the inside out.

13. The device defined in claim 12, wherein said booster spring means include at least one pair of spring pads having a plurality of spaced downwardly projecting locating pins operatively fixed to said crossbar, a T-shaped guideway slideably mounted to said main plate, a C-shaped channel reciprocatively mounted to said guideway, a pair of radially extending arms mounted to said channel, spring pad sleeve means mounted to each of said radially extending arms, and booster springs mounted between said spring pads and said spring pad and sleeve means.

14. The device defined in claim 5, wherein said push rods are of square cross section.

15. The device defined in claim 5, wherein said push rods are of circular cross section.

16. The device defined in claim 2, and including a drain opening provided in said outer wash tub, a valve connected to said opening, and a hose connected to said valve.

17. The device defined in claim 2, and including a suitable cabinet substantially surrounding said wash tub and said compressor unit and being fixedly mounted to said support legs.

18. The device defined in claim 17, wherein said inner and outer wash tub are provided with flanges, and said flanges are fixedly mounted to said cabinet.

19. The device defined in claim 2, wherein said support legs are each provided with an adjustable mounting pad.

20. The device defined in claim 1, wherein said outer wash tub is provided with a suitable drain opening.

21. The device defined in claim 20, and including a valve connected to said drain opening, and a hose connected to said valve.

22. The device defined in claim 21, and including a suitable cabinet substantially surrounding said wash tub and said compressor unit and being fixedly mounted to said support legs.

23. The device defined in claim 22, wherein said inner and outer wash tub are provided with flanges, and said flanges are fixedly mounted to said cabinet.

24. The device defined in claim 23, wherein said support legs are each provided with an adjustable mounting pad.

* * * * *